US011225737B2

(12) United States Patent
Filip

(10) Patent No.: US 11,225,737 B2
(45) Date of Patent: Jan. 18, 2022

(54) COMPOSITE TEXTILE MATERIAL FOR THE MANUFACTURING OF THERMOFORMED PRODUCTS, METHOD AND MACHINERY FOR ITS MANUFACTURING

(71) Applicant: Ioan Filip, Targu Lapus (RO)

(72) Inventor: Ioan Filip, Targu Lapus (RO)

( * ) Notice: Subject to any disclaimer, the term of this patent is extended or adjusted under 35 U.S.C. 154(b) by 445 days.

(21) Appl. No.: 16/083,107

(22) PCT Filed: Mar. 1, 2017

(86) PCT No.: PCT/IB2017/051209

§ 371 (c)(1),
(2) Date: Sep. 7, 2018

(87) PCT Pub. No.: WO2017/153870

PCT Pub. Date: Sep. 14, 2017

(65) Prior Publication Data

US 2019/0330775 A1 Oct. 31, 2019

(30) Foreign Application Priority Data

Mar. 8, 2016 (RO) ..... a 2016 00160

(51) Int. Cl.

| | |
|---|---|
| ***D04H 1/4266*** | (2012.01) |
| ***D01B 1/00*** | (2006.01) |
| ***D04H 1/4291*** | (2012.01) |
| ***D04H 1/46*** | (2012.01) |

(52) U.S. Cl.

CPC ..... *D04H 1/4266* (2013.01); *D01B 1/00* (2013.01); *D04H 1/4291* (2013.01); *D04H 1/46* (2013.01)

(58) Field of Classification Search

CPC ..... D04H 1/4266; D04H 1/4291; D04H 1/46; D04H 1/558; D04H 1/544; D04H 1/70; D04H 1/732; D04H 1/736; D04H 18/02; D01B 1/00; D01G 23/00–08; D01G 21/00

See application file for complete search history.

(56) References Cited

U.S. PATENT DOCUMENTS 2,885,741 A * 5/1959 Leineweber, Jr. ..... D01G 13/00 19/145.5
3,192,571 A * 7/1965 Halleux ..... D01G 23/06 19/65 R (Continued)

FOREIGN PATENT DOCUMENTS

| | | | |
|---|---|---|---|
| EP | 1211138 | A1 | 6/2002 |
| JP | H10296707 | A | 11/1998 |
| WO | 2006112599 | A1 | 10/2006 |

OTHER PUBLICATIONS

European Patent Office (ISA), International Search Report dated May 24, 2017 for PCT International Application No. PCT/IB2017/051209, international filing date Mar. 1, 2017, priority date Mar. 8, 2016.

(Continued)

*Primary Examiner* — Nathan E Durham
*Assistant Examiner* — Abby M Spatz
(74) *Attorney, Agent, or Firm* — Law Office of Andrei D Popovici, PC

(57) ABSTRACT

A composite material developed for manufacturing thermoformed products has applications in furniture making, automotive industry, etc. The composite material for thermoforming is made of a thermoplastic fibrous component consisting of 4-60 mm long and 7-16 DEN polypropylene fibers representing 40% to 50% of the total material weight, and a plant fiber component which can be hemp, jute, sisal, coconut, etc., or a mix of natural fibers which is 70-80 DEN and 5 to 100 mm in length and represents 60% to 50% of the total material weight. Manufacturing the composite material comprises proportioning the components, followed by mixing and coarse defibering, then fine mixing in a four-chamber module which also opens the natural fibers to 70-80 DEN, followed by the consolidation of the fibers and rolling of the resulting fabric in a roll. The machinery for manu- (Continued)

Figure 1:
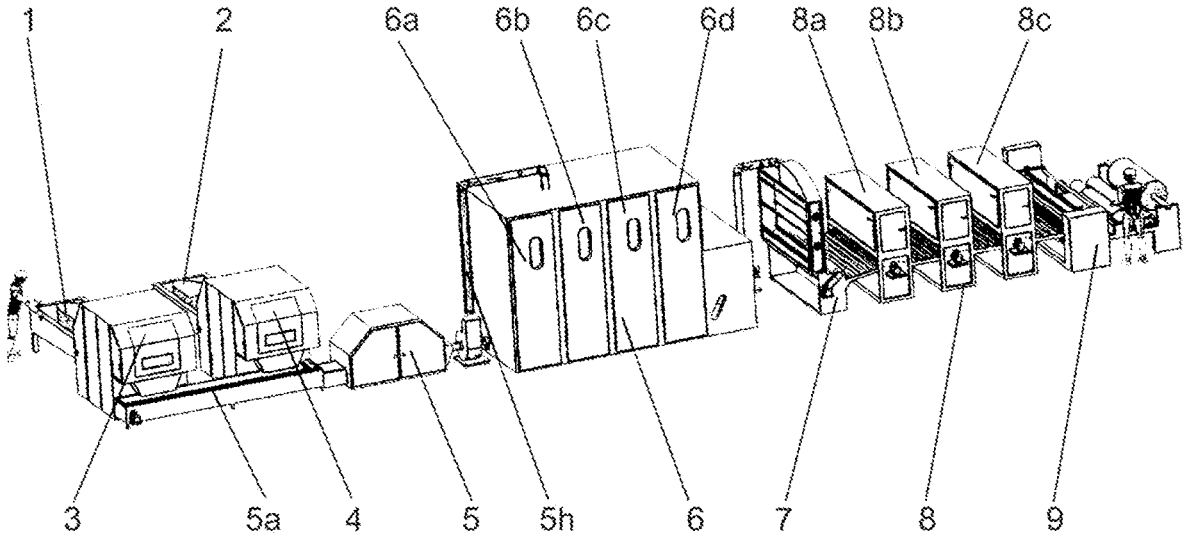

facturing the composite material has a modular structure, comprising two modules (1 and 2) for feeding the components, two modules (3 and 4) for weighing and proportioning the components, a primary mixing and coarse defibering module (5), a module (7) for fine mixing and fiber opening, an interlacing module (8), and a module (9) for pulling and rolling the final fabric.

1 Claim, 2 Drawing Sheets

(56) References Cited

U.S. PATENT DOCUMENTS 3,648,330 A * 3/1972 Binder ..... D01G 13/00 19/145.5
3,889,319 A * 6/1975 Roberson ..... D01G 13/00 19/145.5
4,640,810 A * 2/1987 Laursen ..... D04H 1/732 264/121
2003/0036741 A1* 2/2003 Abba ..... A61F 13/47218 604/385.101
2005/0042378 A1* 2/2005 Grobbel ..... B32B 38/0004 427/355
2006/0067161 A1* 3/2006 Rubenach ..... G01G 19/22 366/141
2010/0261397 A1 10/2010 Sabourin et al.

OTHER PUBLICATIONS

European Patent Office, International Preliminary Report on Patentability dated Jun. 7, 2018 for PCT International Application No. PCT/IB2017/051209, international filing date Mar. 1, 2017, priority date Mar. 8, 2016.

* cited by examiner

COMPOSITE TEXTILE MATERIAL FOR THE MANUFACTURING OF THERMOFORMED PRODUCTS, METHOD AND MACHINERY FOR ITS MANUFACTURING

The invention refers to a composite material developed for manufacturing thermoformed products with applications in furniture making, automotive industry, etc., a method and machinery for manufacturing the material in unwoven form.

The majority of upholstered products have a structure in the form of a wood frame. The wood is an excellent material from a functional, ecological and esthetic viewpoint, but the excessive cutting of trees is starting to take its toll on the environment, and so most of the countries now have very strict logging laws. Due to this reason the manufacturers of large series products that contain wood, among which the furniture manufacturers can be found, are looking for solutions to replace wood with other recyclable materials that offer advantages regarding the productivity and the general cost of the product. For this purpose a series of composite materials made of natural and thermoplastic fibers have been developed, materials which can be thermoformed so as to replace products made of wood.

Patent RO 115182 "Nonwoven textile material and process for its manufacturing" shows a nonwoven layered material that is used mainly in the manufacturing of drainage systems. The material is formed of at least three layers which have alternating fiber thicknesses. The odd layers are formed of 4 . . . 10 DEN and 60 . . . 100 mm long polyester fibers, and the even layers are made of monofilament 160 . . . 220 DEN and 80 . . . 100 long polyester fibers. The manufacturing process of the non-woven textile material is done by carding-interlacing of the odd layers, while the even layers are made by forming a fibrous fabric using compressed air. The final assembly is done by interlacing with needles of size 15×18×32×3½", with an interlacing density of 150 needle stickings/cm$^2$ and a depth of travel of 9 mm.

The described composite material does not have thermoforming specific properties and the manufacturing method of carding-interlacing is not efficient for making a composite fabric used in thermoforming.

Patent WO2006052967 "Composite thermoplastic sheets including natural fibers" shows a laminated composite material that is made of a porous core that includes at least one thermoplastic material and natural fibers of jute, linen, hemp, coconut, etc., which make up 80% of the total weight of the porous core. This material is used in numerous products because of its ease of manufacturing through thermoforming. Among the products made so one can find decorative panels for car interiors or public transportation systems and architectural use. The manufacturing method of the composite involves mixing natural fibers with a length of 5 to 50 mm with a thermoplastic resin powder in order to obtain an aqueous foam mix. The natural fibers are set on a wire mesh, then the water is drained and the fibers are heated and compressed to obtain a porous sheet of the desired thickness.

The disadvantage of this method of manufacturing the composite material lies in the difficulty of draining the aqueous solution completely before rolling the material onto rolls. Burning these materials to dispose of them at the end of lifecycle is an impractical solution because they contain fiberglass.

Patent KR970008215 "Thermoplastic composite material reinforced with hemp fibers" refers to a composite material made of a thermoplastic reinforced with hemp fibers and filler represented by wood. The wood filler can be particles, powder or chips and is dispersed homogenously throughout the thermoplastic matrix. The thermoplastic can be polypropylene, polyethylene, a copolymer of ethylene and polypropylene, a copolymer of acrylonitrile-butadiene-styrene or simply nylon. The thermoplastic material may contain anorganic filler such as talcum or plastifiers/lubricants depending on the desired properties. The composite is manufactured as sheets used in die-cutting or pellets used in injection molding.

Patent FR2781492 "Composite thermoplastic material for use in production of various molded articles, includes hemp fibers of specified dimensions and humidity" refers to a thermoplastic composite which includes hemp fibers of sizes and humidity fit for molded products. The composite material is formed of a thermoplastic with a maximum melting point of 200° C. and hemp fibers shorter than 2 mm and with a diameter smaller than or equal to 0.2 mm. The hemp fibers' humidity is maximum 4% of the fibers' mass. The patent describes a method of manufacturing the material that consists of melting the thermoplastic and mixing hemp fibers into it.

The disadvantage of the material obtained by the patented method consists of the fact that it has small strength due to the short fibers and is recommended to be used in injection molding and less for thermoforming.

Patent DE19950744 "Production of a thermoplastic composite material involves mixing and compressing starch-based polymers with shavings of natural plant fibers, followed by melting, homogenization and granulation" refers to the fabrication of a composite thermoplastic material through the mixing and compressing of starch-based polymers with natural fibers, followed by melting, homogenization and granulation of the obtained material. The novelty consists of using a plant derived polymer which together with the natural fibers produces a biodegradable material. The composite material is fabricated by heating the thermoplastic to 120° C. between the laminating rollers, followed by the mixing of natural fibers and homogenization between another set of rollers and the granulation of the material through cooling at the end.

The disadvantages of the known materials consist either in the weak mechanical properties or in the specific weight and specific strength.

The problem solved by the present invention is the manufacturing of a composite material suited for making thermoformed articles, the material being low-cost, 100% recyclable, needing a low content of synthetic materials derived from hydrocarbons and having the advantage of being made primarily out of a fast growing natural resource.

The composite material for thermoforming is made of a thermoplastic fibrous component consisting of 4-60 mm long and 7-16 DEN fine polypropylene fibers representing 40% to 50% of the total material weight and a plant fiber component which can be hemp, jute, sisal, coconut, etc., or a mix of natural fibers which is 70-80 DEN fine and 5 to 100 mm in length and represents 60% to 50% of the total material weight.

The manufacturing process of the composite material consists of the following operations:

a. taking the plant fibers from the bale and cutting them to lengths between 5 and 100 mm, using a rotating blade chopping machine b. simultaneous weighing of the plant fibers resulted from the previous phase and polypropylene fibers with a length of 60 mm and 7-16 DEN fine using two scales, opening the chutes and periodically releasing a quantity between 0.5 and 2 kg on a conveyor belt in order to obtain a mix for the composite material of which the plant fibers represent 50-60% of the total mass c. coarse mixing of the plant and polypropylene fibers and defibering them with the help of a fiber opener with nails, then transferring the material to a mixer with four vertical chambers d. mixing and finely shredding the materials which is carried out at first in the chambers of the four chamber mixer where the material is fed by compressed air in order to obtain the mixing of the two components, then comes the second phase, where the fibrous material from each of the chambers is shred with the help of the nail rollers which feed fibrous layers onto a conveyor belt where four overlaid layers are made, one from each chamber of the mixer, this allowing an optimum homogenization of the two components, then the obtained material is sent to another feeder which transfers the material with the help of compressed air to the surface of two perforated rollers which rotate in opposite directions and create a blanket that is homogenous in terms of weight/surface unit e. interlacing the material with the help of barbed needle machines which consolidate the fibrous layer by routing the upper layer fibers to the lower layer and the fibers in the lower layer to the upper layer, increasing the strength of the fibrous material and implicitly reducing its thickness by a factor of 4 to 5 f. pulling and rolling the material with the help of two rollers in order to make a fabric with consolidated fibers (by interlacing) and packaged as a roll The machinery for producing the composite material consists of at least two feeding modules, one for the thermoplastic fibers and the other for the plant fibers, one module which weighs and feeds correct proportions of each type of fiber, one module for the primary mixing and the coarse defibering, one module for the fine mixing and defibering, one module for interlacing and one module for pulling and rolling the material.

Figure 2:
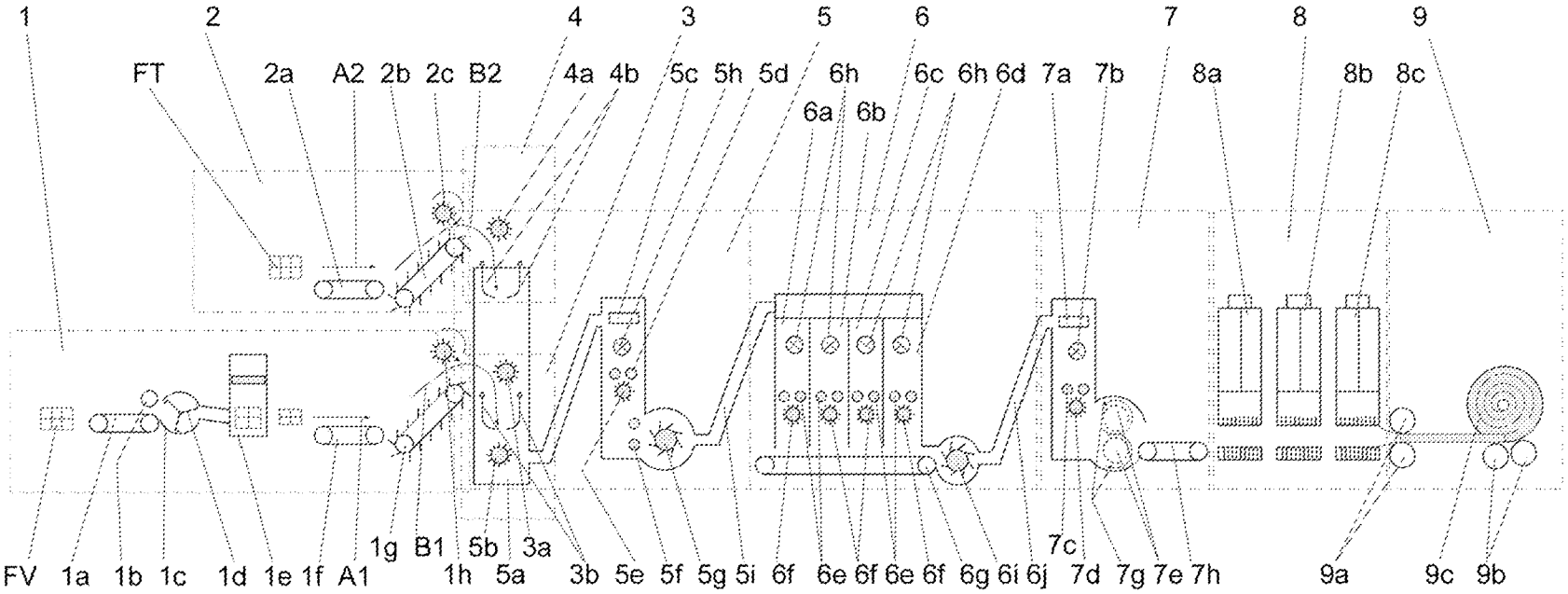

The following presents an example of such a machinery with the help of FIGS. 1 and 2 which represent:

FIG. 1 represents the modular structure of the machinery for the manufacturing of the composite material FIG. 2 represents the technological schematic of the machinery for the manufacturing of the composite material.

The machinery for the manufacturing of the composite textile material is made of the following modules:

- module 1, which takes the plant fibers from the bale, chops them to the predetermined length and feeds them to the next module;
- module 2, which feeds the thermoplastic fibers to the next module;
- module 3, for weighing and periodical feeding of the plant fibers on a conveyor belt 5*a* of module 5, for primary homogenization;
- module 4, for weighing and periodical feeding of the thermoplastic fibers on a conveyor belt 5*a* of module 5;
- module 5, for the homogenization and primary opening of the textile fibers;
- module 6, for the homogenization and fine defibering to a value of 70-80 DEN;
- module 7 for the compressing and forming of the composite fabric;
- module 8, for the interlacing;
- module 9, for the rolling of the obtained fabric.

Module 1 consists of a conveyor belt 1*a* that has a roller 1*b* at one end, which feeds the plant fibers FV to a chopper 1*c*, with rotating blades 1*d*. Chopper 1*c* cuts the plant fibers FB to a length between 5 and 100 mm. The length of the fibers is set by tuning the speed of the conveyor belt 1*a* with the speed of the rotating blades 1*d*. The shortened plant fibers FV go through a pressing device 1*e* and are then transferred on a horizontal conveyor belt 1*f*, then onto an inclined conveyor belt 1*g*. Conveyor belt 1*g* has nails which prevent the material from sliding on it. This way conveyor belt 1*g* takes a great part of the fiber quantity and the formed fibrous layer will be equalized by the equalizing roller 1*h* that rotates opposite to the travel direction of the inclined conveyor belt, and the excess material will fall onto conveyor belt 1*g* which will homogenize the fibrous material.

Plant fibers FV are transferred in the direction of arrows A1 and B1 of module 3 at a constant flow.

Module 2, for the feeding of the thermoplastic fibers FT is composed of a conveyor belt 2*a* and a conveyor belt 2*b*, that is inclined and has nails. The thermoplastic fibers FT are transferred in the direction of arrows A2 and B2 towards module 4 at a constant flow that is tuned by the equalizing roller 2*c*.

Module 3 consists of a decompressing roller 3*a*, which takes plant fibers FV from conveyor belt 1*g*, and a weigh hopper 3*b*. Weigh hopper 3*b* weighs and releases equal quantities of plant fiber FV onto conveyor belt 5*a*.

Weigh hoppers 3*b* and 4*b* open periodically and empty onto conveyor belt 5*a* the necessary quantity of each component of the composite in order to obtain the right mix percentages.

Module 5, used for the homogenization and primary opening of the textile fibers, takes quantities of each material component from conveyor belt 5*a* periodically and, with the help of roller 5*b* which is a nail decompressor, the material is transferred into compressor 5*c*. The material passes between two feeding rollers 5*d* to fiber opener 5*e*, and then together with two other feeding rollers 5*f* goes to a horizontal fiber opener 5*g*. The horizontal opener ensures that the fibers get opened up to 150-200 DEN fine.

A pressure switch 5*h* controls the feeding of condenser 5*c* depending on the value of the pressure inside it.

The mix is sent from the horizontal opener 5*g* through tubing 5*i* to module 6 for homogenization and fine defibering.

Module 6 is fed with a mix of fibers through the upper part of the four vertical chambers 6*a*, 6*b*, 6*c* and 6*d*. Each vertical chamber 6*a*, 6*b*, 6*c* and 6*d* is fitted with two feeder rollers 6*e* and fiber opener roller 6*f*.

For a better homogenization of the textile fibers with the thermoplastic fibers, conveyor belt 6*g* periodically releases approximately equal quantities of mixed material from each of the chambers 6*a*, 6*b*, 6*c*, 6*d* by controlling the timing of the feeder rollers 6*e* of the chambers using photocells 6*h*.

From conveyor belt 6*g* the fibrous material mix goes to fiber opener 6*i* which opens the material to 70-80 DEN, and from here, through tubing 6*j*, the material goes to compression module 7.

Compression module 7 contains compressor 7*a*. The fibrous material is detached from condenser 7*a* and falls into the aspiration bunker that controls the flow using photocell 7*b*, and is then taken by the feeding rollers 7*c* and opened by the fiber opener roller 7*d*.

A rigid gasket with saw like teeth sends fiber packages to the surfaces of the two perforated rollers 7*e* which rotate opposite to one another (arrows 7*g*) thus obtaining a uniform thickness of the fabric which is then detached by a deflecting shield. Thus, the fabric is lead onto conveyor belt 7*h* and from here on to module 8, for the interlacing.

Module 8 contains 3 interlacing machines 8*a*, 8*b* and 8*c*. Each machine has a set of barbed needles that pass the fibers from the upper layer to the lower layer and vice-versa, thus obtaining a consolidation of the fibrous material through the interlacing of the fibers.

Next the consolidated material is taken up by a rolling module 9 with the help of rollers 9*a* and lead to the rolling system that consists of two lower rollers 9*b* which rotate in the same direction and package the composite material in the form of roll 9*c*.

The main differences in the proposed technological process as compared to the known solutions are presented in table 1.

TABLE 1

| Operation | Existing solution | Proposed solution |
|---|---|---|
| Component fiber opening | uses a double card which subjects the fibers to stress and results in fibers of different lengths<br>fibers with a high wood content cannot be opened | uses a nail fiber opener with a rigid gasket that protects the fibers' characteristics<br>a large array of fibers can be used, including plants with more than 20% plant fiber content |
| Machinery cost | more expensive and higher maintenance machinery<br>limited carding capability<br>high energy consumption | shorter workflow<br>easier maintenance<br>2-3 times higher capacity<br>60% of the energy consumption of the existing processes |
| Component mixing | double card<br>around 30-40% waste results from the opening and mixing stage | four chamber mixing module<br>waste is under 10% |
| Fibrous layer making | the forming is done by plying the fibrous layer that exits the card<br>limited capacity due to the chopping speed of the plyer | the forming of the fibrous layer makes fibers with multiple orientations<br>2 to 3 times greater processing capacity |

The textile material can be used for various applications:

- automotive industry: dashboards, front bumpers, door interiors, consoles, trunks, etc.
- furniture industry: sofas, tables, furniture, hangers, mirror frames, chairs, drawers
- products for home use: trays, dishes, etc.

By applying the invention the following advantages are obtained:

- obtaining recyclable materials, that do not contain toxic compounds, with multiple applications (automotive industry, furniture industry, home goods, etc.)
- rapid growth raw materials are used which can grow anywhere on earth
- reduced dependency on hydrocarbons
- reduced water consumption in both the production of the raw material as well as in manufacturing
- reduced electric energy consumption/kg of material
- low workforce needed and fast productivity growth
- the manufacturing process uses machinery specific to plant fibers which is easy to build and run
- the technology doesn't pollute because the waste can be reused in the manufacturing of new material and doesn't give off toxic gases into the atmosphere.

The invention claimed is:

1. A manufacturing process for the production of a composite fabric material comprising a) 40-50 wt % of a $1^{st}$ component made of thermoplastic fibers (FT) with a length of 4 to 60 mm and a denier of 7-16 DEN; and b) 50-60 wt % of a $2^{nd}$ component made of plant fibers (FV) with a denier of 70-80 DEN and a fiber length of 5 to 100 mm;

the manufacturing process including the followings steps:

a) cutting the plant fibers (FV) to lengths of 5 to 100 mm using a rotating blade chopping machine, b) weighing the plant fibers (FV) resulting from the previous step in one weighing hopper, weighing the thermoplastic fibers (FT) in another weighing hopper, opening corresponding chutes and periodically releasing a quantity between 0.5 and 2 kg of each fiber on a conveyor belt in order to obtain a mix in which the plant fibers represent 50-60% of the total mass, c) coarsely mixing the plant and thermoplastic fibers, defibering the plant and thermoplastic fibers by means of a fiber opener, and transferring the plant and thermoplastic fibers to a mixer having multiple chambers, d) mixing the first and second components and finely opening their fibers using nail rollers, each of the rollers taking out one fiber layer at a time from a corresponding chamber of the mixer and laying the fiber layer onto a conveyor belt, thus creating multiple overlaid fiber layers, and transferring the overlaid fiber layers by means of compressed air to two perforated rollers spinning in opposite directions to one another to create a homogenous composite fabric, e) consolidating the composite fabric by interlacing using a machine with barbed needles, and f) rolling the consolidated composite fabric for packaging as a roll.

* * * * *